US006565080B1

(12) United States Patent
Schaefer et al.

(10) Patent No.: US 6,565,080 B1
(45) Date of Patent: May 20, 2003

(54) IMAGING MEDIA LOADING GUIDE

(75) Inventors: Cori A. Schaefer, San Diego, CA (US); Chet M. Butikofer, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 24 days.

(21) Appl. No.: 10/022,480

(22) Filed: Dec. 17, 2001

(51) Int. Cl.[7] ..... B65H 1/00
(52) U.S. Cl. ..... 271/171
(58) Field of Search ..... 271/171, 144, 271/223

(56) References Cited

U.S. PATENT DOCUMENTS 5,931,456 A * 8/1999 Laidlaw ..... 271/171

FOREIGN PATENT DOCUMENTS

JP 7-144452 * 6/1995 ..... B41J/13/10

* cited by examiner

*Primary Examiner*—Donald P. Walsh
*Assistant Examiner*—Kenneth W Bower

(57) ABSTRACT

An imaging media tray includes at least one adjustable guide operatively connected to an interior surface of the imaging media tray. The guide divides the interior of the tray into a loading section and an unused section. A blocking mechanism is secured in the unused section of the media tray to prevent a user of the tray from loading imaging media into the unused section of the tray. The blocking mechanism can be provided as an adjustable blocking element with a an expandable and contractible mechanical blocker connected between the at least one adjustable guide and an interior wall of the tray. Illustrated embodiments show the blocker as a telescoping member and as a pivoting cross member arrangement.

20 Claims, 3 Drawing Sheets

IMAGING MEDIA LOADING GUIDE

FIELD OF THE INVENTION

The invention relates generally to imaging media loading in imaging systems. Specifically, the invention relates to a method and apparatus for increasing the likelihood of correct imaging media loading.

BACKGROUND OF THE INVENTION

The ever-changing demands of global commerce, coupled with the almost unlimited capabilities of state-of-the-art imaging systems, has resulted in a need for a wide variety of document types and formats. The days of "letter or legal" have gone the way of carbon paper and mimeographs. Imaging systems are capable of handling a variety of standard sizes, such as letter, legal, A4, and A5-ISO, as well as custom sheet sizes.

Rather than require system users to have on hand a different sheet tray for each sheet size, it is known to provide cassette trays having the ability to handle a relatively wide range of sizes. Such trays are sometimes provided with sliding rear adjustable "backstops" which may accommodate different sheet lengths, and/or side slide-plates adjustable to communicate sheet size information to the printer central control system.

Two approaches to sheet size adjustability are exemplified by the optional 500-sheet tray and the standard 250-sheet tray associated with the Hewlett-Packard LaserJet 4000T printer. The optional 500-sheet tray supports standard sheet sizes, as well as custom sizes. The sheet size in the tray is communicated to the printer by contact with combinations of three levers on the side of the tray. The levers are capable of selective contact with switches on the interior of the sheet infeed housing when the tray is inserted into the printer. Each sheet size is associated with a unique set of lever positions. The levers are moved in and out by the slide-plate, which is mounted on the side of the tray. The slide-plate is provided with a plurality of holes corresponding to the lever combinations associated with the various sheet sizes. Levers are prevented from actuating their associated switches when the levers are aligned with holes, and can actuate switches when they are aligned with the "flats", or closed portions of the slide-plate. The slide-plate is moved-by turning a dial located on the side of the tray, which serves to push or pull the slide-plate. The printer user is required to manually set the dial for each paper size, which may be perceived as inconvenient.

The standard 250-sheet trays are equipped to automatically sense sheet size. The backstop of the tray is movable, and is mechanically linked to the slide-plate. When the backstop is moved to positions corresponding to standard sizes, the slide-plate is moved to a position exposing the proper levers, as with the optional 500-sheet tray. Although adjustment of the tray communicates differences between standard sizes automatically, the standard tray is unable to accommodate custom sizes.

Another typical adjustable tray is that associated with the Optra S2450 printer manufactured by Lexmark. The Optra S2450 operates in much the same way as the LaserJet 4000 standard tray, but also permits adjustment for some custom sizes. The Optra 2450 slide-plate has holes for standard sizes. When the backstop moves the slide-plate to a non-standard position, all levers are actuated, thus setting the switches to read a custom size. Unfortunately, the backstop and slide-plate of the Optra 2450 tray are incapable of independent adjustment. Consequently, the Optra S2450 tray cannot accommodate custom sheet sizes having the same length as standard sizes.

The patent literature also presents examples of adjustable imaging media trays, as shown in U.S. Pat. No. 5,901,952 to Hourtash. The Hourtash patent is directed to a paper supply tray having a bottom wall, left and right side walls, a front wall and a rear wall; a side wall paper guide laterally movable with respect to and connected to the supply tray. A front wall paper guide is longitudinally moveable with respect to and connected to the supply tray. The apparatus further includes a mechanical connector that engages both the paper guides in a manner such that the movement of one of the guides generates a corresponding movement of the other guide. The apparatus provides for a coupled width and length adjustment thereby allowing the user to conform both dimensions with only one manipulation In another example, U.S. Pat. No. 5,574,551 to Kazakoff, automatic detection of the size of print media in a supply bin is provided by electrical devices. Adjustable print media alignment fences are operatively connected to the electrical devices, such as potentiometers, photovoltaic strips, photoemitter-photodetector arrays, or the like. The output signals from the electrical devices are correlated to width and length dimensions of the print media or the absence of print media availability. Embodiments are disclosed for standard and custom print media size detection.

The adjustability of these known systems present a different problem. Specifically, when backstops or side guides are adjusted at or near the midpoint of the tray, the "unused" side of the tray may be of similar size to, or even larger than, the "loading" side of the tray. Consequently, users loading media into the tray are susceptible to confusion as to which side of the tray the imaging media is to be placed. It has been proposed to place labels in the unused side of the tray to warn users against placing media incorrectly. Unfortunately, such labels are largely ignored and thus ineffective.

It can be seen from the foregoing that the need exists for a simple, inexpensive, arrangement for reducing the likelihood of incorrect imaging media placement in an adjustable media tray.

SUMMARY OF THE INVENTION

The present invention is directed to an imaging media tray including at least one adjustable guide operatively connected to an interior surface of the imaging media tray. The guide divides the interior of the tray into a loading section and an unused section. A blocking mechanism is secured in the unused section of the media tray to prevent a user of the tray from loading imaging media into the unused section of the tray. The blocking mechanism can be provided as an adjustable blocking element with a an expandable and contractible mechanical blocker connected between the at least one adjustable guide and an interior wall of the tray. Illustrated embodiments show the blocker as a telescoping member and as a pivoting cross member arrangement.

DETAILED DESCRIPTION OF THE INVENTION

Figure 1:
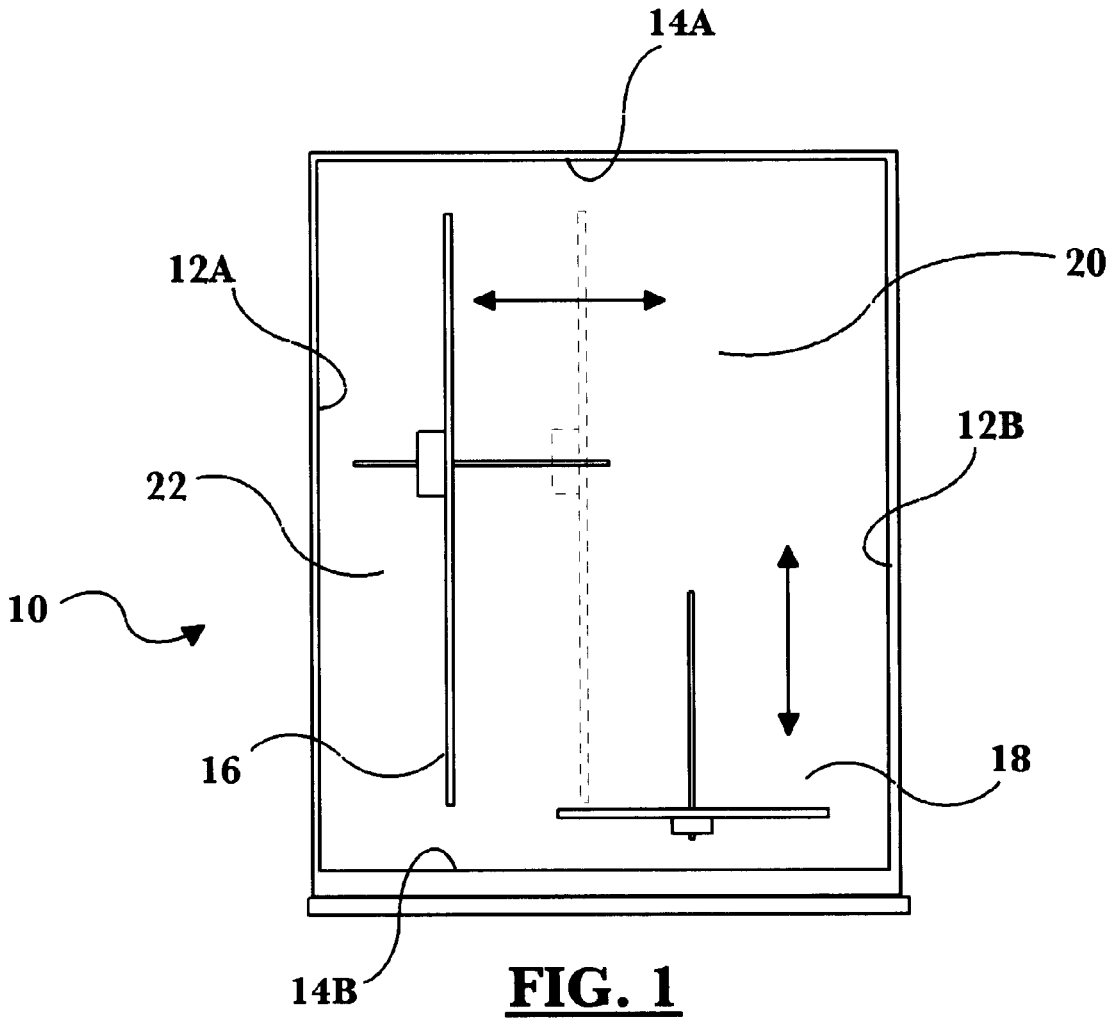
FIG. 1 (PRIOR ART)
FIG. 1 is a schematic plan view of a known imaging media tray.

A typical imaging media tray 10 is shown in FIG. 1. The imaging tray 10 includes an interior defined by sidewalls 12A, 12B and endwalls 14A, 14B. The effective interior size of the tray 10 can be varied to accommodate different sizes of imaging media by moving the lateral guide 16 and the back stop 18 to the desired size. Adjustment of the guides 16, 18creates a loading section 20 and an unused section 22 in the tray 12. There is no striking visual differentiation between the loading section 20 and the unused section 22, especially when the lateral guide 16 is adjusted to a position near the center of the tray 12, as shown in broken line in FIG. 1. As described previously, this situation can lead to user confusion, which often results in placement of imaging media on the wrong side of the tray. Incorrect media loading can not only cause mispicks and jams, but may physically damage system components such as lifting plate motors and gears.

Figure 2:
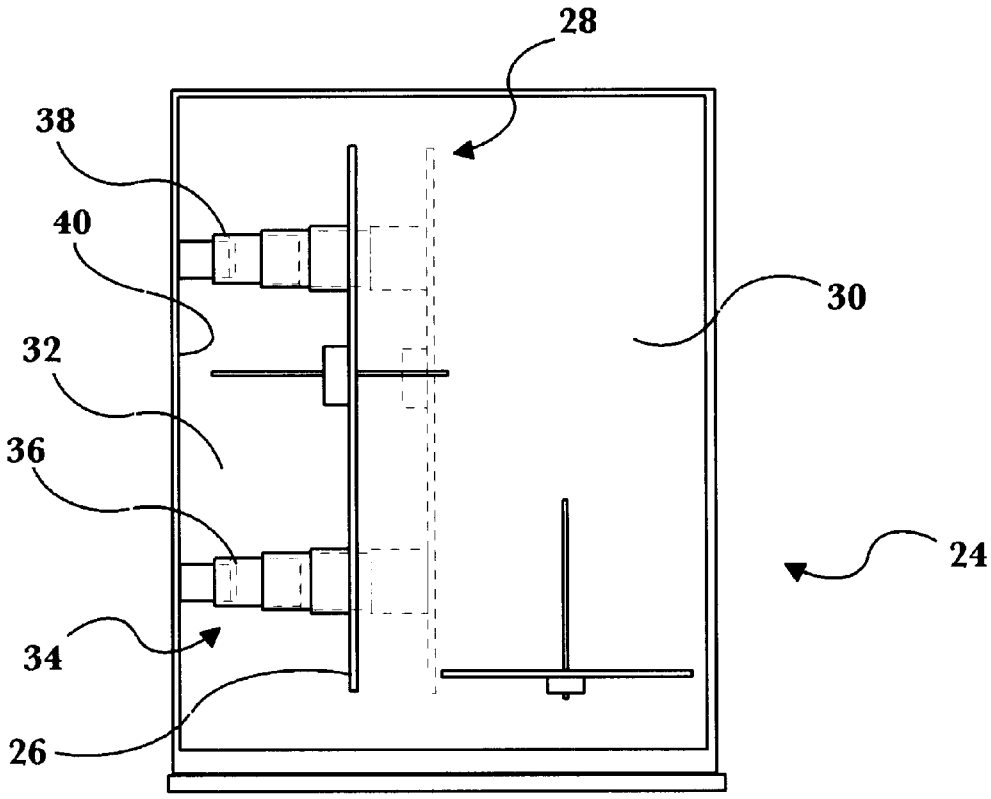
FIG. 2 is a schematic plan view of an imaging media tray and blocking mechanism in accordance with the principles of the present invention.
Figure 3:
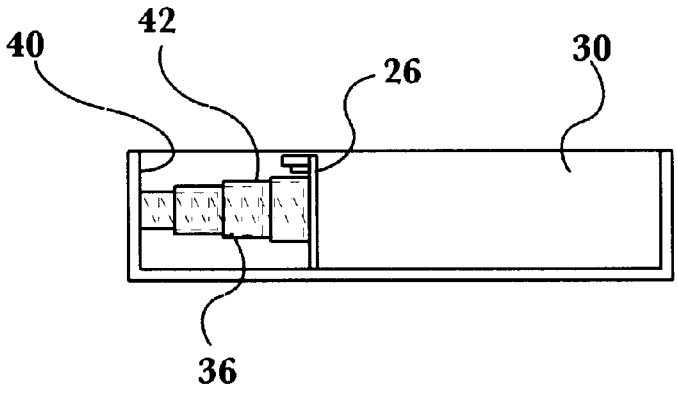
FIG. 3 is a schematic sectional view taken generally along lines III—III of FIG. 2.

An imaging tray 24 in accordance with the principles of the present invention is shown in FIGS. 2 and 3. The imaging tray 24 includes an adjustable guide 26 operatively connected to an interior surface 28 of the imaging media tray 24. The guide 26 divides the interior of the tray 24 into a loading section 30 and an unused section 32.

A blocking mechanism 34 is secured in the unused section 32 of the media tray 24. The blocking mechanism 34 includes a pair of adjustable blocking elements 36, 38 connected between the adjustable guide 26 and an interior wall 40 of the tray 24. The blocking elements 36, 38 are mechanically expandable and contractible, and are moved by adjustment of the guide 26. In the illustrated embodiment, the blocking elements 36, 38 are provided as telescoping members. A spring assist element 42 is secured in the telescoping members 36, 38 to facilitate ease of movement.

When the adjustment guide 26 is moved, the blocking elements 36, 38 expand and contract in conjunction with the variation in size of the unused section 32 of the tray 24. Thus, the blocking elements 36, 38 form a constantly-present barrier to placement of imaging media in to the unused section 32, as well as a visual reminder of which side is the "load" side of the tray. It is also contemplated that the blocking mechanism 34 can be provided with a warning color, such as bright red or flourescent orange, on its exterior surface, to further increase user awareness of correct imaging media loading placement.

Figure 4:
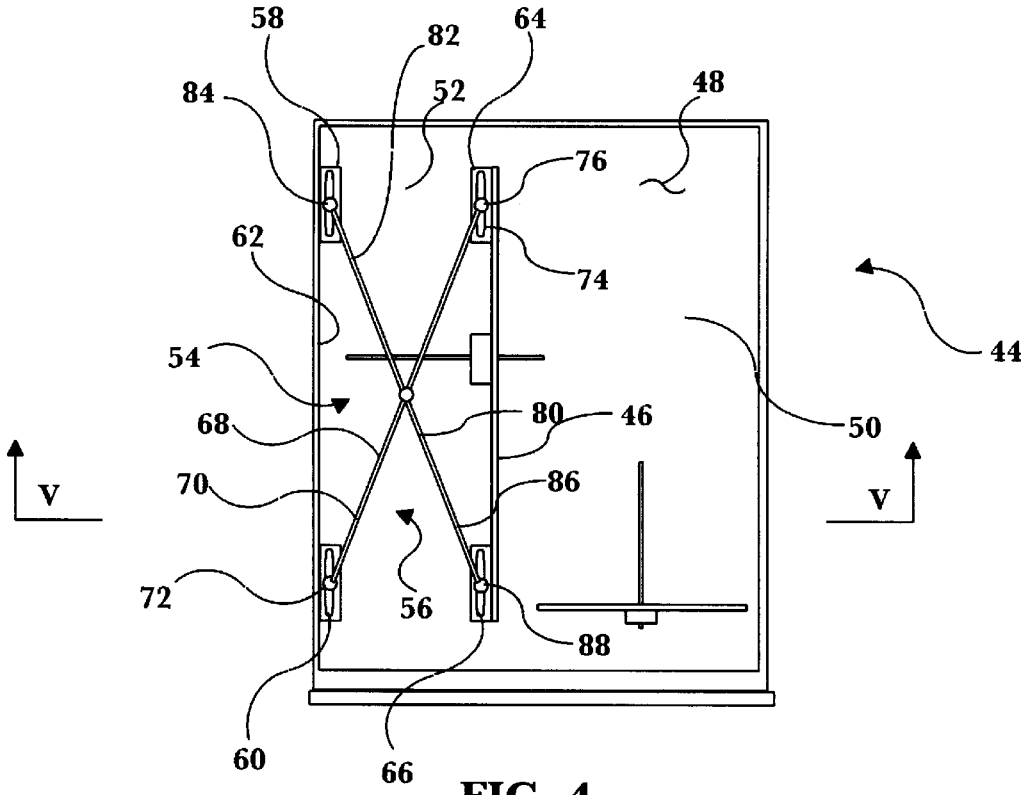
FIG. 4 is a schematic plan view of another embodiment of an imaging media tray and blocking mechanism in accordance with the principles of the present invention.
Figure 5:
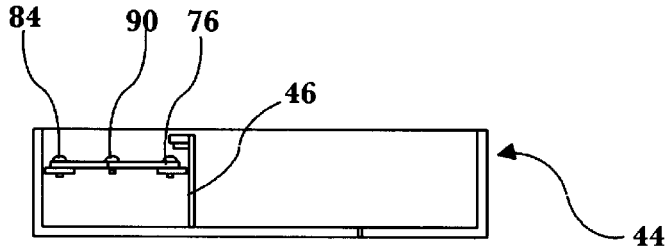
FIG. 5 is a schematic sectional view taken generally along lines V—V of FIG. 4.

Another embodiment of imaging tray 44 in accordance with the principles of the present invention is shown in FIGS. 4 and 5. The imaging tray 44 includes an adjustable guide 46 operatively connected to an interior bottom surface 48 of the imaging media tray 44. The guide 46 divides the interior of the tray 44 into a loading section 50 and an unused section 52.

A blocking mechanism 54 is secured in the unused section 52 of the media tray 44. The blocking mechanism 54 includes an expandable and contractible mechanical blocker in the form of a pivoting cross member arrangement 56. The pivoting cross member arrangement 56 includes a first pair of slot guides 58, 60 secured to an interior wall 62 of the imaging media tray 44. A second pair of slot guides 64, 66 is secured to the adjustable guide 46. A first cross member 68 has a first end 70 secured in the first guide slot 60 via a sliding pin 72. A second end 74 of the first cross member 68 is secured in the second guide slot 64 via a sliding pin 78. In identical fashion, s second cross member 80 has a first end 82 secured in the first guide slot 58 via a sliding pin 84. A second end 86 of the first cross member 80 is secured in the second guide slot 66 via a sliding pin 88. A central pivot pin 90 secures the first cross member 68 to the second cross member 80.

When the adjustment guide 46 is moved, the pivoting cross member arrangement 56 expands and contracts in conjunction with the variation in size of the unused section 32 of the tray 24. Thus, the pivoting cross member arrangement 56 varies in appearance from a line when the guide 46 is in its leftmost position in FIG. 4 to an "X" as the guide 46 moves to the right. The pivoting cross member arrangement 56 forms a constantly-present barrier to placement of imaging media in to the unused section 52, as well as a visual reminder of which side is the "load" side of the tray. It is also contemplated that the pivoting cross member arrangement 56 can be provided with a warning color, such as bright red or flourescent orange, on its exterior surface, to further increase user awareness of correct imaging media loading placement.

Although the present invention has been described with reference to specific embodiments, those of skill in the art will recognize that changes may be made thereto without departing from the scope and spirit of the invention as defined by the appended claims.

What is claimed is:

1. An imaging media tray comprising the following:

at least one adjustable guide operatively connected to an interior surface of the imaging media tray, the guide dividing the interior of the tray into a loading section and an unused section; and a blocking mechanism secured in the unused section of the media tray, the blocking mechanism being adapted and constructed to prevent a user of the tray from loading imaging media into the unused section of the tray.

2. An imaging media tray in accordance with claim 1, wherein the blocking mechanism comprises an adjustable blocking element.

3. An imaging media tray in accordance with claim 2, wherein the adjustable blocking element is connected between the at least one adjustable guide and an interior wall of the tray.

4. An imaging media tray in accordance with claim 3, wherein the blocking element is mechanically expandable and contractible.

5. An imaging media tray in accordance with claim 4, wherein the blocking element comprises a telescoping member.

6. An imaging media tray in accordance with claim 5, further comprising a spring assist element secured in the telescoping member.

7. An imaging media tray in accordance with claim 4, wherein the blocking element comprises a pivoting cross member arrangement.

8. An imaging media tray in accordance with claim 7, wherein the pivoting cross member arrangement comprises the following:

a first pair of slot guides secured to an interior wall of the imaging media tray;

a second pair of slot guides secured to the at least one adjustable guide;

a first cross member having a first end secured in one of the first guide slots and a second end secured in one of the second guide slots;

a second cross member having a first end secured in one of the first guide slots and a second end secured in one of the second guide slots; and a pivot pin pivotably securing the first-cross member to the second cross member.

9. An imaging media tray in accordance with claim 1, wherein the blocking mechanism is provided with a warning color on its exterior surface.

10. In an imaging media tray having an interior divided into a loading section and an unused section by at least one adjustable guide, a movable blocking mechanism secured in the unused section of the media tray, the blocking mechanism being adapted and constructed to prevent a user of the tray from, and warn a user against, loading imaging media into the unused section of the tray.

11. An imaging media tray in accordance with claim 10, wherein the blocking mechanism comprises at least one adjustable blocking element connected between the at least one adjustable guide and an interior wall of the tray, the blocking element being secured for motion with the at least one adjustable guide.

12. An imaging media tray in accordance with claim 11, wherein the blocking element is mechanically expandable and contractible.

13. An imaging media tray in accordance with claim 12, wherein the blocking element comprises a plurality of telescoping members.

14. An imaging media tray in accordance with claim 13, further comprising a respective spring assist element secured in each of the telescoping members.

15. An imaging media tray in accordance with claim 14, wherein the blocking element comprises a pivoting cross member arrangement.

16. An imaging media tray in accordance with claim 15, wherein the pivoting cross member arrangement comprises the following:

a first pair of slot guides secured to an interior wall of the imaging media tray;

a second pair of slot guides secured to the at least one adjustable guide;

a first cross member having a first end secured in one of the first guide slots and a second end secured in one of the second guide slots;

a second cross member having a first end secured in one of the first guide slots and a second end secured in one of the second guide slots; and a pivot pin pivotably securing the first cross member to the second cross member.

17. An imaging media tray in accordance with claim 16, wherein the blocking mechanism is provided with a warning color on its exterior surface.

18. In an imaging media tray having an interior divided into a loading section and an unused section by at least one adjustable guide, a method for preventing a user of the tray from, and warn the user against, loading imaging media into the unused section of the tray, the method comprising the following steps:

securing a movable blocking mechanism in the unused section of the media tray between the at least one adjustable guide and an interior wall of the tray;

moving the at least one adjustable guide to cause the blocking mechanism to block the unused section of the tray.

19. A method in accordance with claim 18, wherein the step of securing a movable blocking mechanism in the unused section of the media tray comprises securing at least one telescoping member in the unused section of the media tray.

20. A method in accordance with claim 18, wherein the step of securing a movable blocking mechanism in the unused section of the media tray comprises securing a pivoting cross member arrangement in the unused section of the media tray.

* * * * *